US011591869B2

(12) United States Patent
Jones

(10) Patent No.: US 11,591,869 B2
(45) Date of Patent: Feb. 28, 2023

(54) VARIABLE FLOW DIVERTER DOWNHOLE TOOL

(71) Applicant: Tenax Energy Solutions, LLC, Clinton, OK (US)

(72) Inventor: Kevin Dewayne Jones, Clinton, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 144 days.

(21) Appl. No.: 17/185,390

(22) Filed: Feb. 25, 2021

(65) Prior Publication Data

US 2021/0270100 A1 Sep. 2, 2021

Related U.S. Application Data

(60) Provisional application No. 62/983,599, filed on Feb. 29, 2020.

(51) Int. Cl.
*E21B 21/10* (2006.01)
*E21B 34/06* (2006.01)
*E21B 37/00* (2006.01)

(52) U.S. Cl.
CPC ..... *E21B 21/103* (2013.01); *E21B 34/06* (2013.01); *E21B 37/00* (2013.01)

(58) Field of Classification Search
CPC ..... E21B 21/103
See application file for complete search history.

(56) References Cited

U.S. PATENT DOCUMENTS

| | | | | |
|---|---|---|---|---|
| 3,054,415 | A | 9/1962 | Baker et al. | |
| 3,799,278 | A | 3/1974 | Oliver | |
| 4,520,870 | A | 6/1985 | Pringle | |
| 4,685,520 | A | 8/1987 | McDaniel | |
| 5,960,881 | A | 10/1999 | Allamon et al. | |
| 7,677,304 | B1 | 3/2010 | Smith | |
| 8,522,877 | B2 | 9/2013 | Chambers et al. | |
| 8,657,009 | B2 | 2/2014 | Themig et al. | |
| 8,657,018 | B2 | 2/2014 | Cravatte | |
| 10,450,814 | B2 | 10/2019 | Jones | |
| 2005/0072572 | A1 | 4/2005 | Churchill | |
| 2008/0093080 | A1 | 4/2008 | Palmer et al. | |
| 2011/0278017 | A1 | 11/2011 | Themig et al. | |
| 2013/0133949 | A1 | 5/2013 | Xu et al. | |
| 2013/0299184 | A1 | 11/2013 | Ali et al. | |
| 2015/0068763 | A1 | 3/2015 | Jepp et al. | |
| 2015/0361764 | A1 | 12/2015 | Ley | |
| 2019/0003283 | A1 | 1/2019 | Atkins et al. | |
| 2021/0189815 | A1* | 6/2021 | Shen | E21B 21/103 |

* cited by examiner

*Primary Examiner* — Robert E Fuller
(74) *Attorney, Agent, or Firm* — Tomlinson McKinstry, P.C.

(57) ABSTRACT

A downhole tool configured to vary the amount of pressurized fluid delivered to other tools incorporated into a bottom hole assembly, such as a mud motor. The tool comprises an inner element installed within an outer sleeve. The inner element is configured to move between three different positions relative to the outer sleeve. In a first position, pressurized fluid is diverted away from downstream tools within the bottom hole assembly. In a second and third position, pressurized fluid is directed towards downstream tools. Movement of the tool between the different positions is caused by varying external forces applied to the tool.

20 Claims, 16 Drawing Sheets

VARIABLE FLOW DIVERTER DOWNHOLE TOOL

SUMMARY

The present invention is directed to a downhole tool. The tool comprises an elongate outer sleeve, an elongate inner element, and a spring. The outer sleeve comprises an upper internal chamber having a base, a lower internal chamber longitudinally spaced from the upper internal chamber and having one or more outer ports interconnecting the lower chamber with an exterior surface of the outer sleeve, and a constricted passageway joining the upper and lower internal chambers.

The inner element has opposed ends and a longitudinal bore extending therethrough. The inner element comprises an enlarged upper body formed at one of the ends. The upper body has a base and is situated within the upper chamber. The inner element also comprises an enlarged lower body formed at the opposite end and situated within the lower chamber. The lower body has one or more laterally-extending inner ports that join the bore to an exterior surface of the lower body. The inner element further comprises a constricted connector that rigidly joins the upper and lower bodies and extends partially within the passageway.

The spring is installed within the upper chamber and is situated between the base of the upper body and the base of the upper chamber. At least one of the outer ports aligns with a corresponding one of the inner ports when the spring is relaxed.

The present invention is also directed to a downhole tool comprising an elongate outer sleeve and an elongate inner element. The outer sleeve has opposed first and second surfaces interconnected by an internal chamber and has one or more outer ports interconnecting the internal chamber with an exterior surface of the outer sleeve. A portion of the inner element is installed within the internal chamber and has one or more laterally-extending inner ports communicating with the internal chamber. The inner element also comprises a stop element positioned outside of the internal chamber.

The inner element is configured to move relative to the outer sleeve such that the inner element is movable between first, second, and third positions. In the first position, at least one of the inner ports is aligned with a corresponding one of the outer ports. In the second position, at least one of the inner ports is not aligned within a corresponding outer port and the stop element is engaging the second surface of the outer sleeve. In the third position, at least one of the inner ports is not aligned with a corresponding one of the outer ports and the stop element is spaced from the second surface of the outer sleeve.

DETAILED DESCRIPTION

During the well completion stage of an oil and gas operation, it may be necessary to remove any frac plugs, debris or other abandoned equipment from the cased wellbore in order to prepare the wellbore for production. One strategy for removing such equipment is to mill or grind up the equipment into small pieces that can be flushed from the casing with pressurized fluid. The equipment may be ground into small pieces using a milling system, like the milling system 10 shown in FIG. 1.

Figure 1:
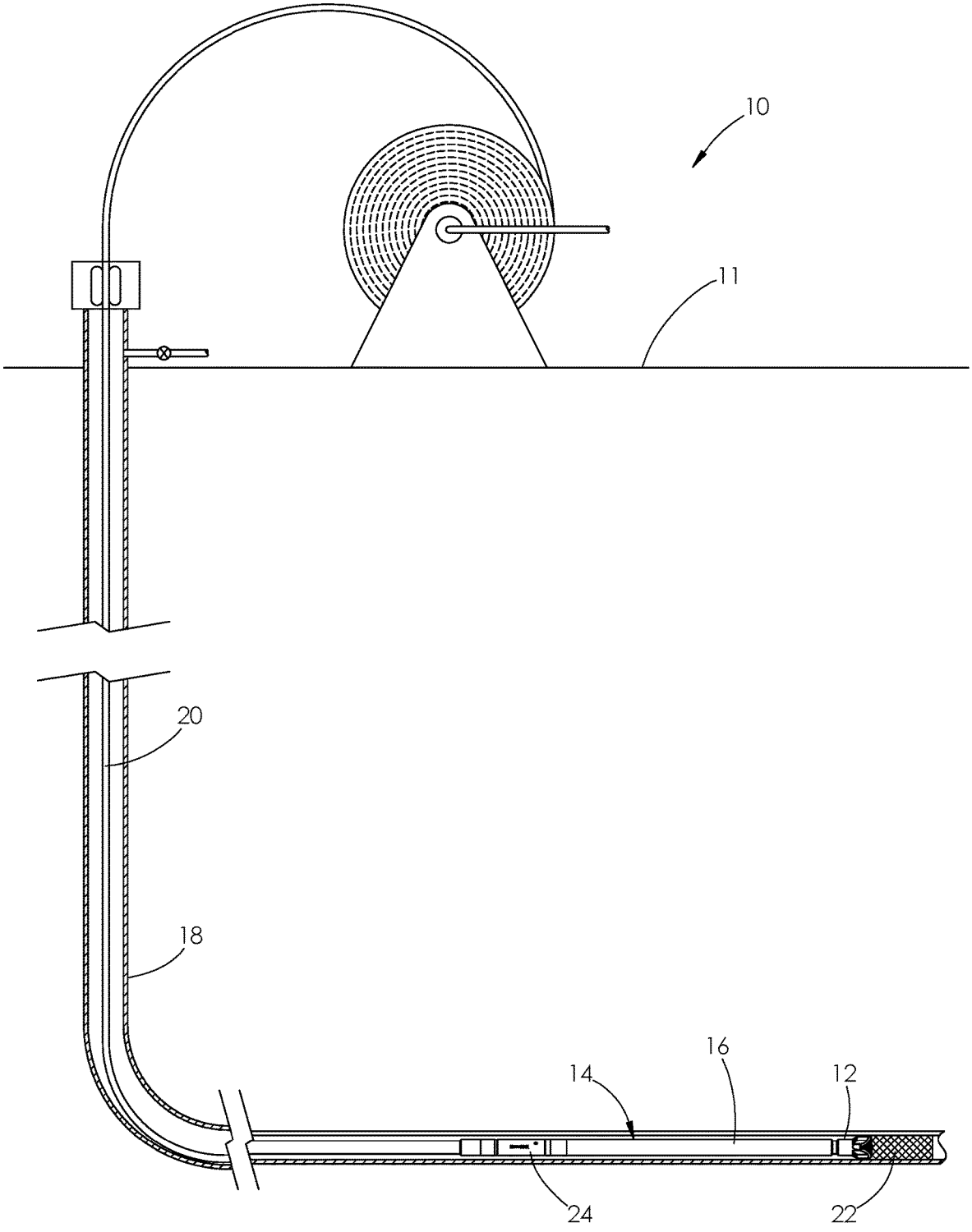
FIG. 1 is an illustration of a milling system installed within an underground cased wellbore.

The milling system 10 shown in FIG. 1 comprises a milling tool 12 incorporated into a bottom hole assembly 14. Rotation of the milling tool 12 is typically powered by a mud motor 16, also incorporated into the bottom hole assembly 14. The bottom hole assembly 14 is lowered into a cased wellbore 18 using an elongate drill string 20. The drill string 20 may be in the form of coiled tubing, as shown in FIG. 1, or jointed pipe.

Continuing with FIG. 1, the milling tool 12 is shown engaging a hardened object 22 within the cased wellbore 18. The hardened object 22 may be a frac plug, debris or other equipment abandoned in the wellbore 18. The milling tool 12 uses blades or carbide teeth to grind the hardened object 22 into small pieces. As mentioned, rotation of the milling tool 12 is powered by the mud motor 16. Mud motors known in the art include a rotor installed within a stator. Pressurized fluid drives rotation of the rotor within the stator, which in turn drives rotation of the milling tool 12.

In operation, the milling tool 12 may travel over 10,000 feet within the horizontal portion of the cased wellbore 18, but only actively mill up objects over 100 feet of the 10,000 feet. Thus, continuous pressurized fluid applied to the milling tool 12 and mud motor 16 while the milling tool 12 is not actively milling may cause the milling tool 12 or mud motor 16 to wear, decreasing its life span. For example, continuous contact of the mud motor's rotor with its stator causes the parts to wear over time, decreasing the efficiency of the mud motor 16. The life span of the milling tool 12 and mud motor 16 can be increased if pressurized fluid is directed away from the mud motor 16 and the milling tool 12 when the milling tool 12 is not actively milling up the hardened object 22.

The present application discloses a variable flow diverter downhole tool 24. The tool 24 may be incorporated into the bottom hole assembly 14 upstream from the mud motor 16, as shown in FIG. 1. The tool 24 may be attached directly to the mud motor 16, as shown in FIG. 1. Alternatively, one or more other downhole tools may be positioned between the tool 24 and the mud motor 16. As will be described in detail herein, the tool 24 functions to divert pressurized fluid away from the mud motor 16 and the milling tool 12, as needed.

Figure 2:
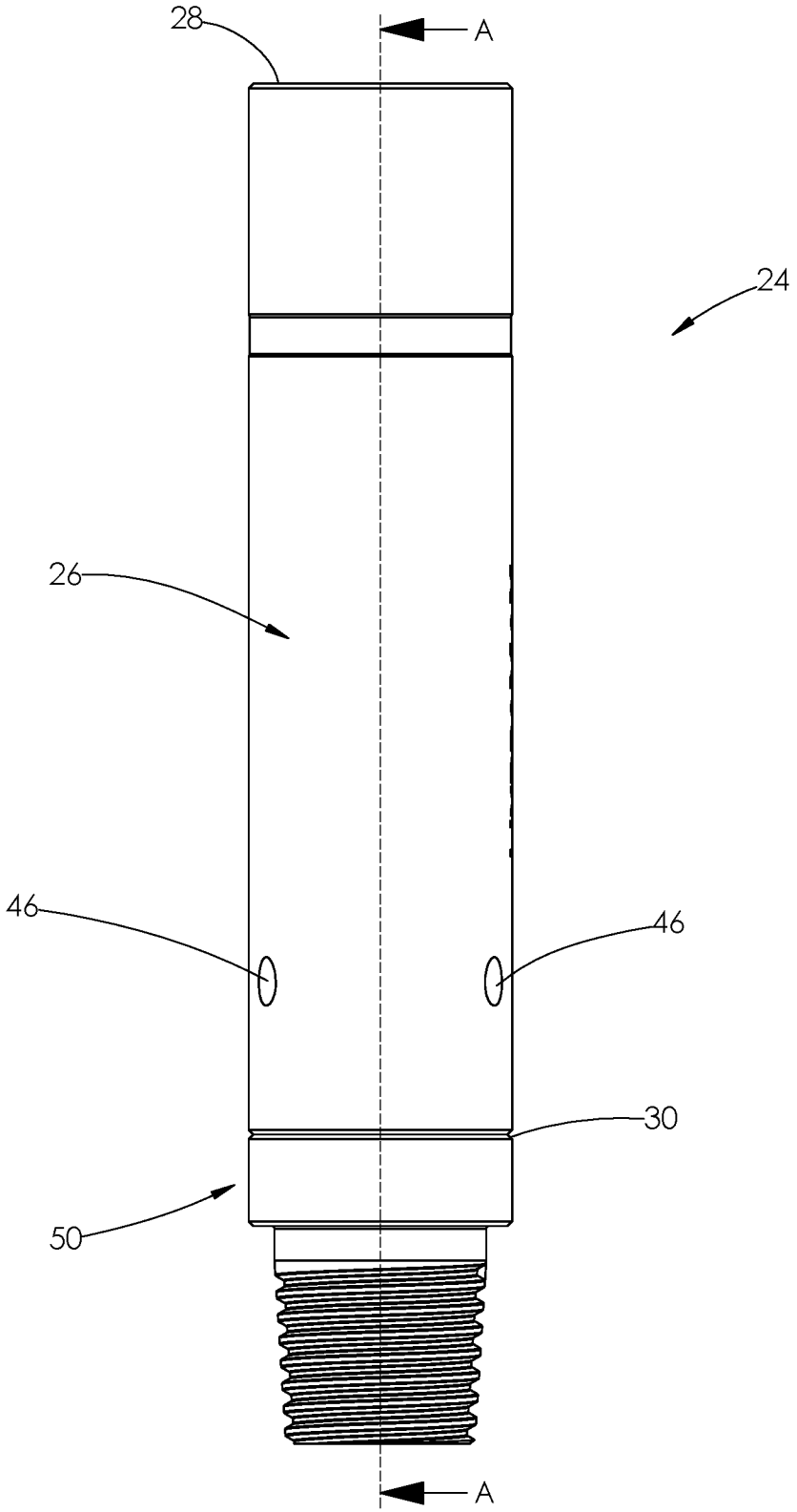
FIG. 2 is a side elevational view of a variable flow diverter tool used with the milling system shown in FIG. 1. The tool is shown in a second position.
Figure 3:
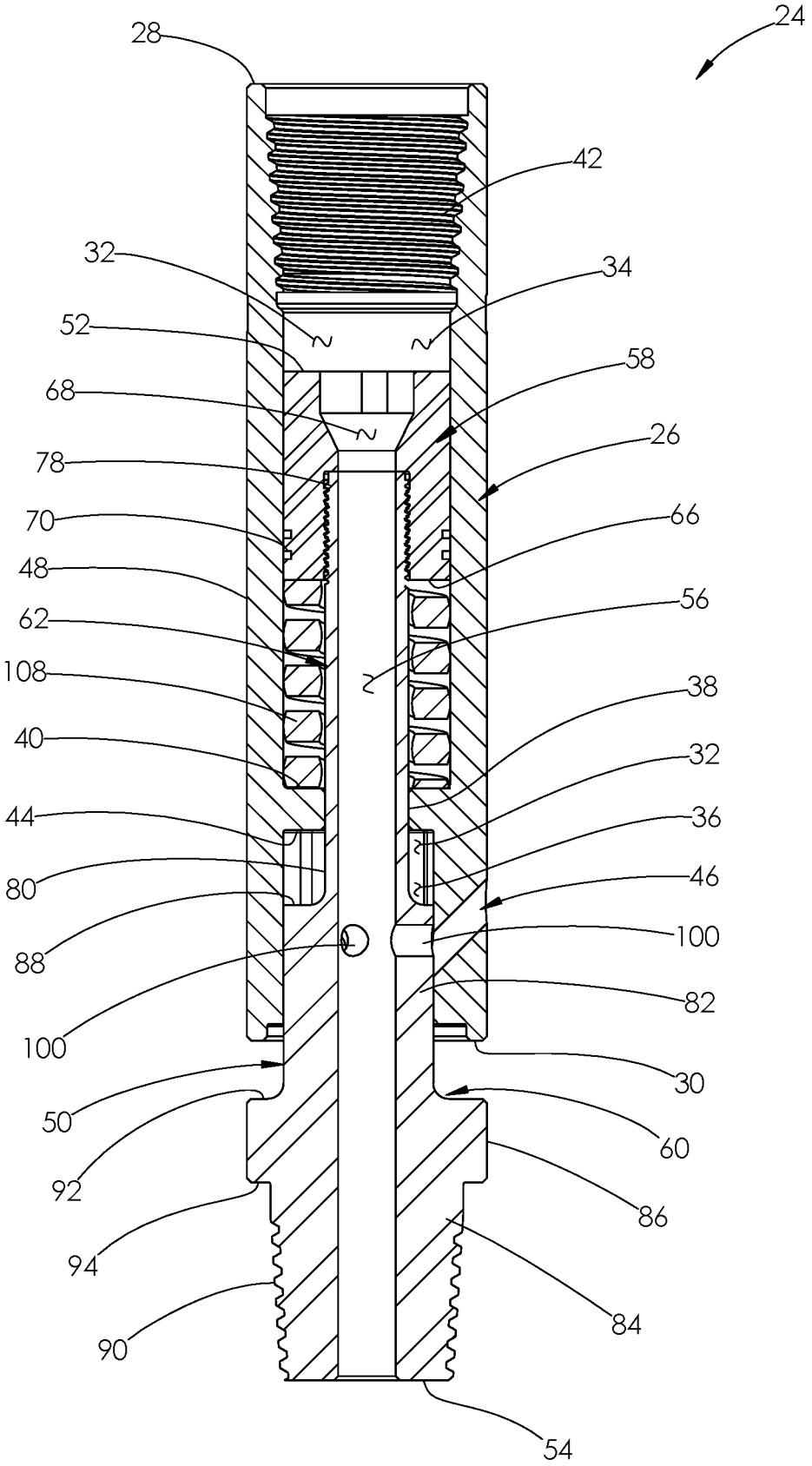
FIG. 3 is a cross-sectional view of the tool shown in FIG. 2, taken along line A-A, but the tool has been moved from the second position to the first position.

Turning to FIGS. 2-6, the tool 24 comprises an elongate outer sleeve 26 having opposed first and second surfaces 28 and 30 interconnected by an internal chamber 32, as shown in FIGS. 2 and 3. The outer sleeve 26 is preferably made of metal. The internal chamber 32 comprises an upper chamber 34 longitudinally spaced from a lower chamber 36. The upper and lower chambers 34 and 36 are joined by a constricted passageway 38.

The upper chamber 34 has a lower base 40 that surrounds the passageway 38. The upper chamber 34 extends between the lower base 40 and the first surface 28 of the outer sleeve 26 and opens at the first surface 28. A plurality of internal threads 42 are formed in the upper chamber 34 opposite the lower base 40 and adjacent the first surface 28. The threads 42 are configured to attach the tool 24 to the drill string 20 or another tool within the bottom hole assembly 14. The lower chamber 36 has an upper base 44 that surrounds the passageway 38 and is positioned opposite the lower base 40. The lower chamber 36 opens at the second surface 30 of the outer sleeve 26.

Figure 4:
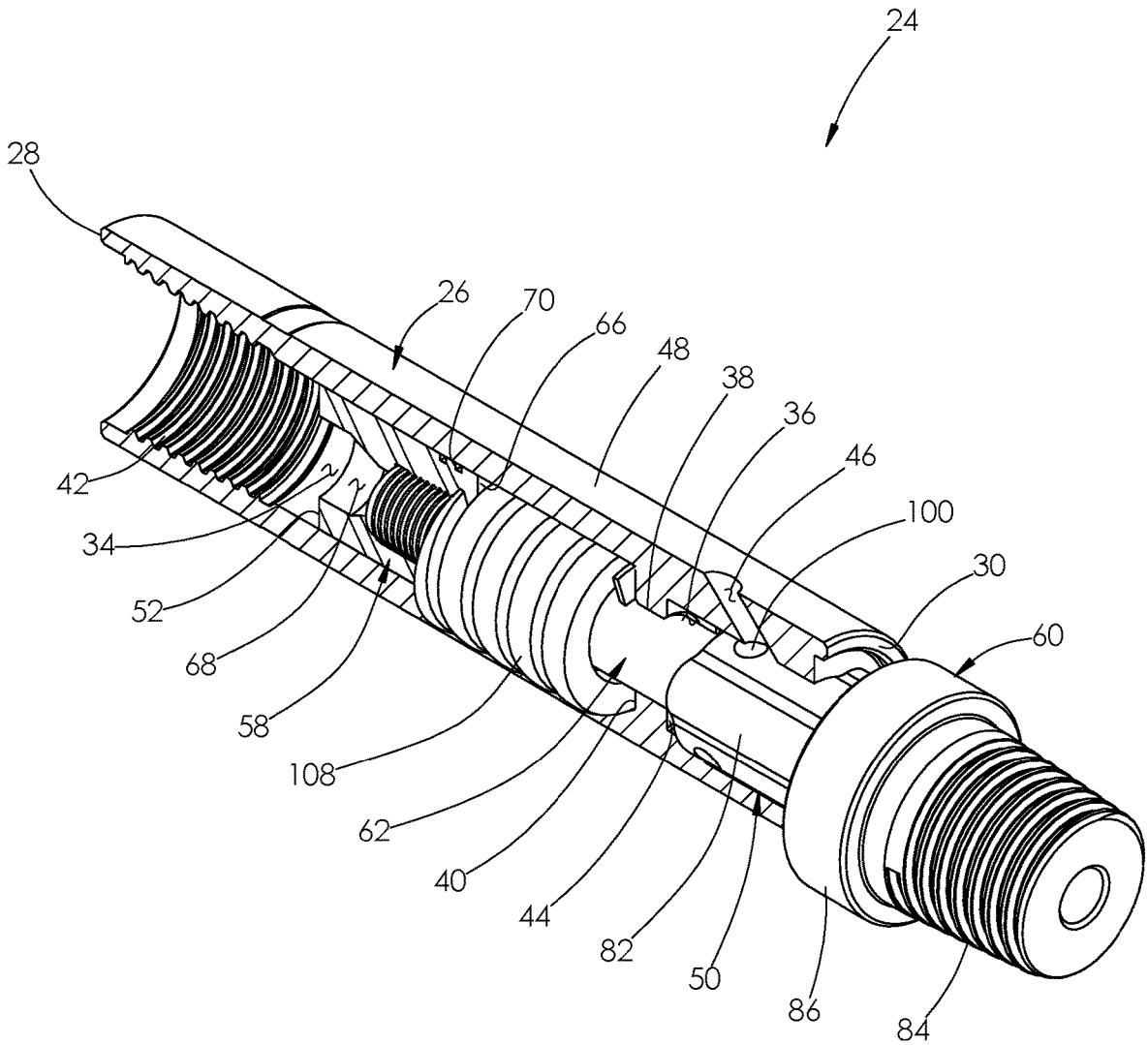
FIG. 4 is a perspective sectional view of the tool shown in FIG. 3.

Continuing with FIGS. 3 and 4, each chamber 34 and 36 has a length and a diameter. The diameters of each chamber 34 and 36 are the same or approximately the same, but the length of the upper chamber 34 is greater than the length of the lower chamber 36. In the embodiment shown in FIG. 3, the length of the upper chamber 34 is greater than two times the length of the lower chamber 36.

One or more laterally-extending outer ports 46 are formed in the outer sleeve 26 and interconnect the lower chamber 36 and an exterior surface 48 of the outer sleeve 26. The outer ports 46 shown in FIGS. 3 and 4 extend at a non-zero and non-right angle relative to a longitudinal axis of the tool 24 and are angled away from the second surface 30 of the outer sleeve 26. In alternative embodiments, the outer ports may be angled towards the second surface of the outer sleeve. In further alternative embodiments, the outer ports may extend at a right angle relative to the longitudinal axis of the tool. The outer sleeve 26 shown in FIGS. 3 and 4 has three outer ports 46. In alternative embodiments, more than three or less than three outer ports may be formed in the outer sleeve.

With reference to FIGS. 3-6, the tool 24 further comprises an elongate inner element 50. The inner element 50 is preferably made of metal. The inner element 50 has opposed first and second surfaces 52 and 54 joined by a longitudinal bore 56. The bore 56 opens at the first and second surfaces 52 and 54 of the inner element 50. The inner element 50 comprises an enlarged upper body 58 and an enlarged lower body 60. The first surface 52 of the inner element 50 is positioned on the upper body 58, and the second surface 54 is positioned on the lower body 60. The upper and lower bodies 58 and 60 are joined by a constricted connector 62.

Continuing with FIGS. 3 and 4, the upper body 58 is situated within the upper chamber 34 of the outer sleeve 26. The upper body 58 has a lower base 66 joined to the first surface 52 by a central passage 68. One or more annular grooves 70 may be formed in the outer surface of the upper body 58 for receiving one or more annular seals (not shown). The seals may be O-rings. The seals engage an inner surface of the outer sleeve 26 and prevent fluid from leaking around the upper body 58 during operation.

Figure 5:
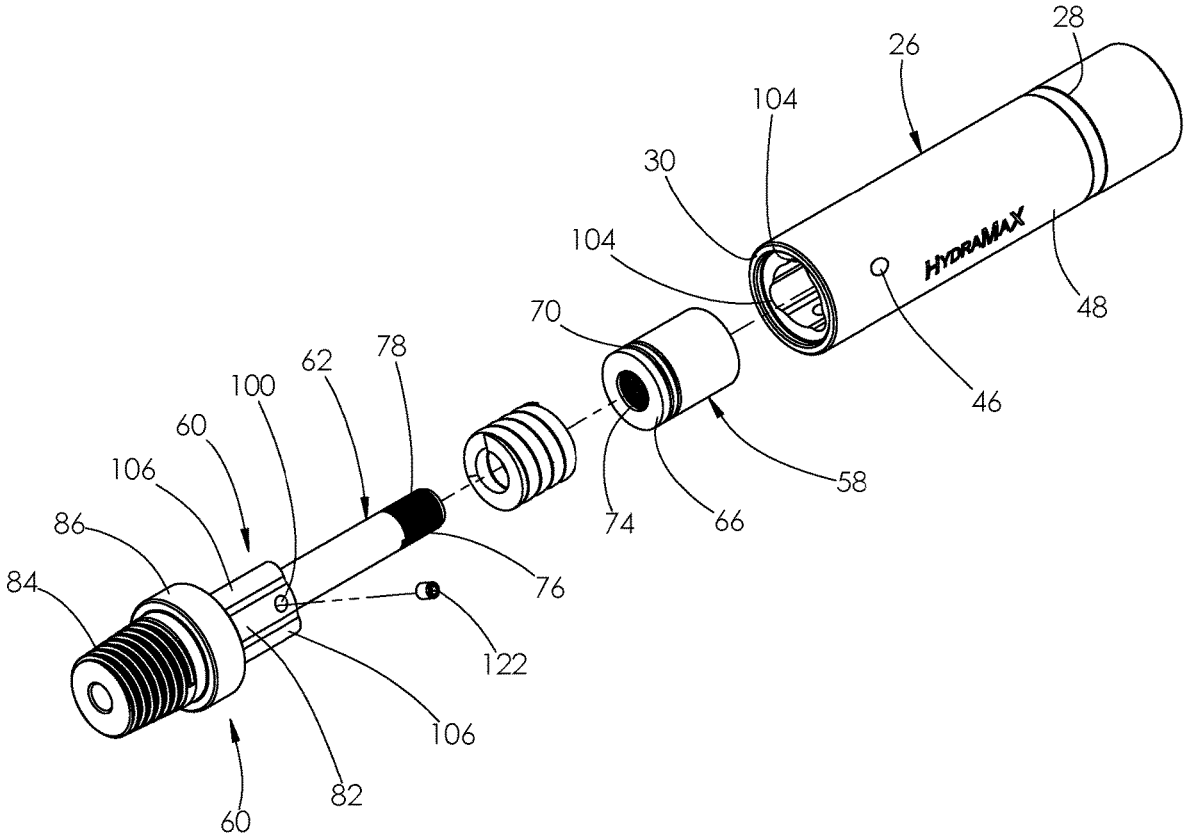
FIG. 5 is a perspective exploded view of the tool shown in FIG. 2.
Figure 6:
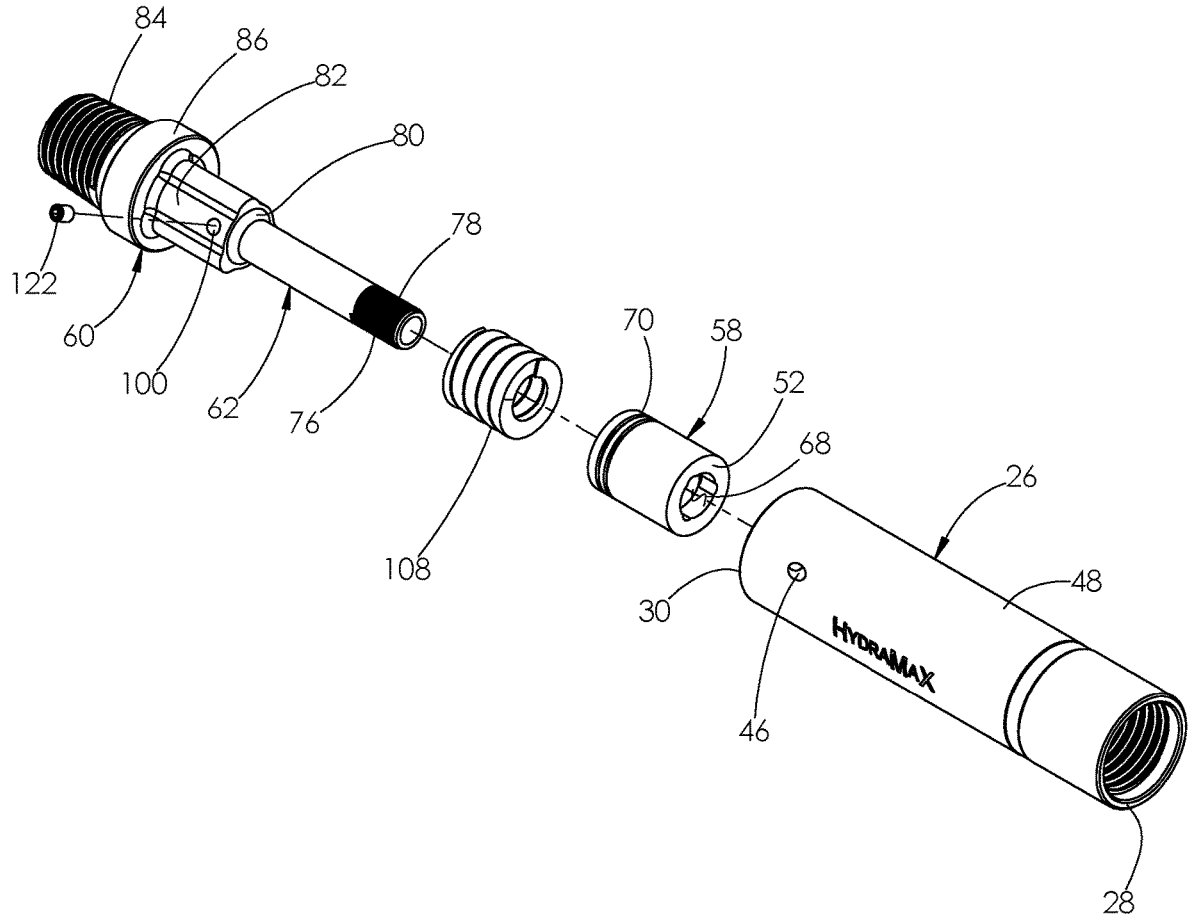
FIG. 6 is a perspective exploded view of the tool shown in FIG. 2, looking the opposite direction as the view shown in FIG. 5.

With reference to FIGS. 5 and 6, a plurality of internal threads 74 are formed in the walls of upper body 58 surrounding the central passage 68 adjacent the lower base 66. The threads 74 are configured to mate with a plurality of external threads 76 formed on a first end 78 of the connector 62. Mating of the threads 74 and 76 rigidly joins the upper body 58 to the connector 62, as shown in FIGS. 3 and 4. Upon connection of the connector 62 to the upper body 58, the central passage 68 formed in the upper body 58 forms an extension of the longitudinal bore 56. The bore 56 widens within the upper body 58 adjacent the first surface 52 and opens into the upper chamber 34.

The upper body 58 and connector 62 shown in FIGS. 3-6 are of two-piece construction. In alternative embodiments, the upper body and the connector may be made of more than two pieces. In further alternative embodiments, the upper body may be attached to the connector using means other than threads, such as being press-fit together.

Continuing with FIGS. 3 and 4, an outer diameter of each of the upper and lower bodies 58 and 60 is greater than an outer diameter of the connector 62. The outer diameter of the connector 62 is sized so that it may be closely received within the passageway 38. A portion of the connector 62 may be situated within both the upper and lower chambers 34 and 36. A second end 80 of the connector 62 is joined to the lower body 60 such that the connector 62 and the lower body 60 are integral with one of another, as shown in FIGS. 3 and 6. In alternative embodiments, the connector and lower body may be separate pieces attached together.

Figure 7:
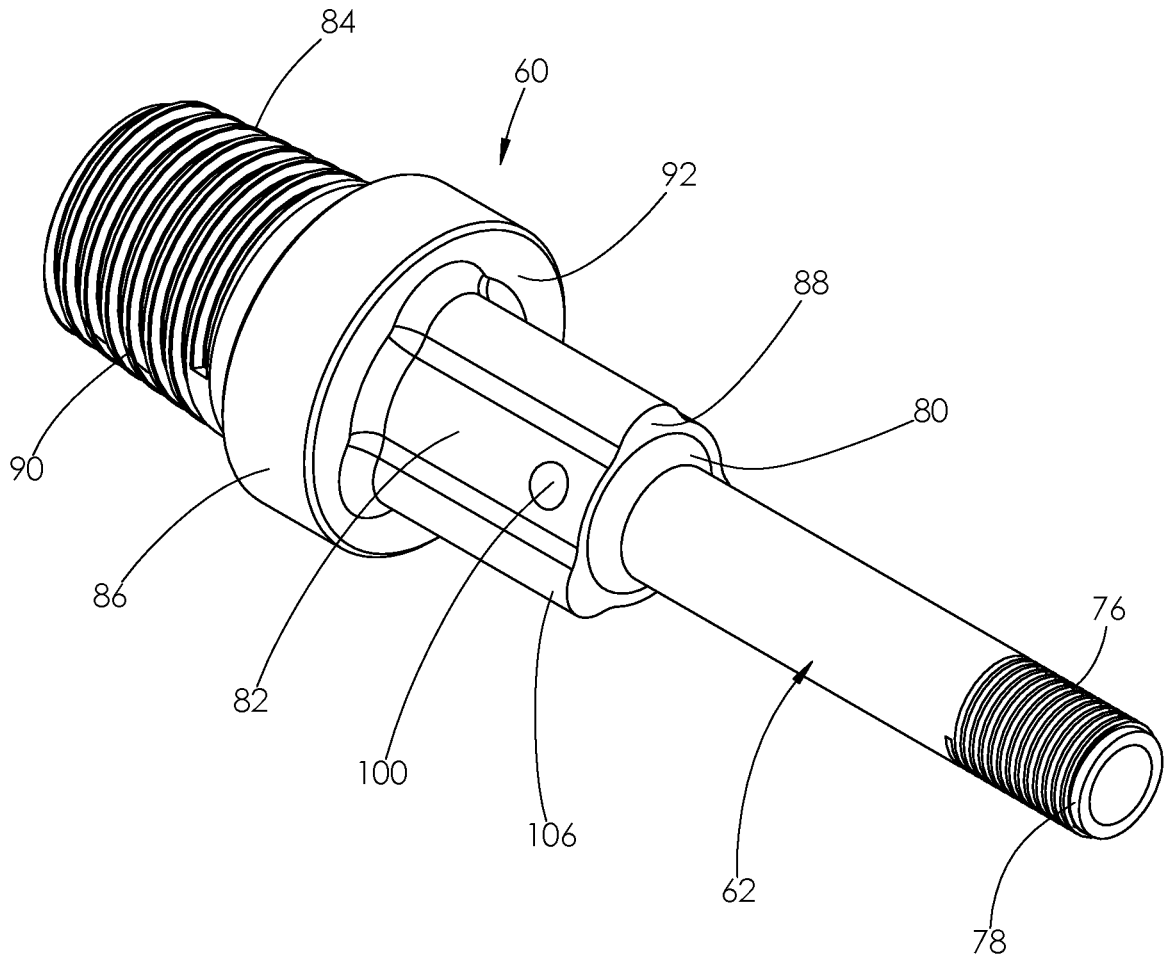
FIG. 7 is a perspective view of the lower body and connector of the inner element installed within the tool shown in FIG. 3.
Figure 8:
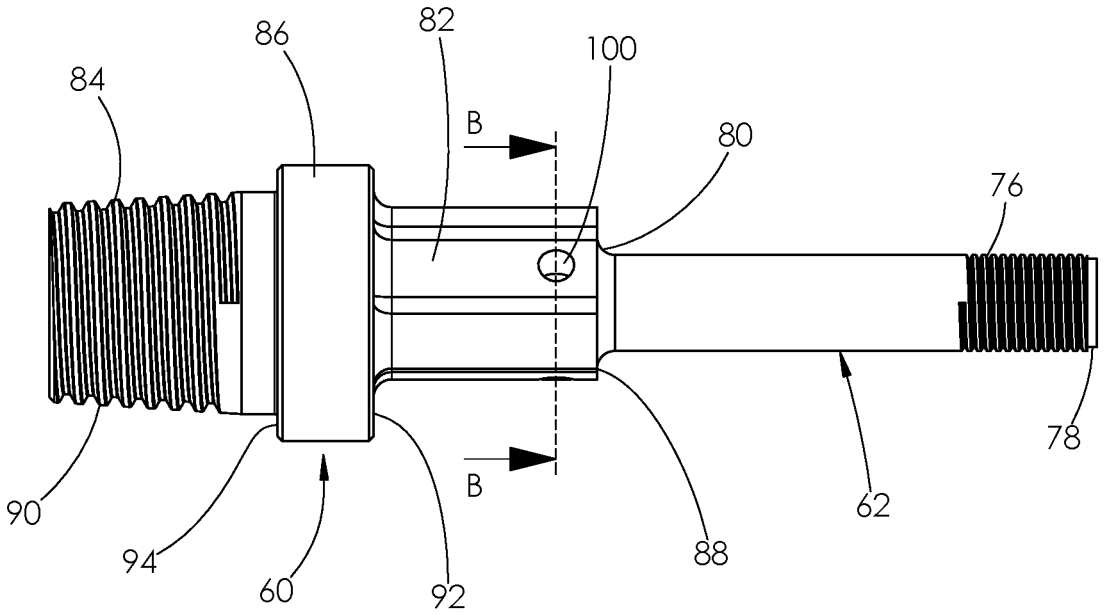
FIG. 8 is a side elevational view of the lower body and connector shown in FIG. 7.
Figure 9:
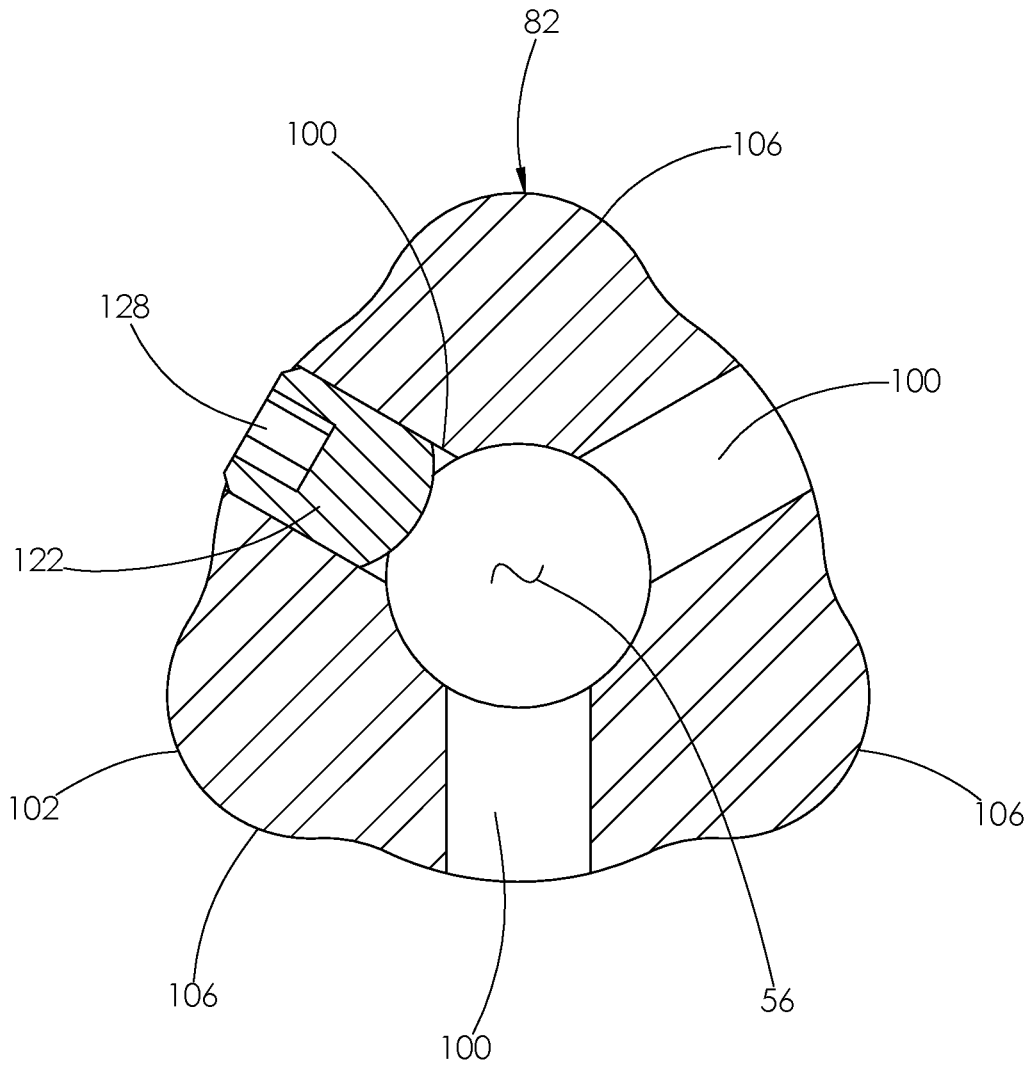
FIG. 9 is a cross-sectional view of the lower body shown in FIG. 8, taken along line B-B.

With reference to FIGS. 7-9, the lower body 60 comprises an upper section 82 joined to a lower section 84 by stop element 86. The upper section 82 is situated within the lower chamber 36 and has an upper base 88, as shown in FIG. 3. The stop element 86 and lower section 84 project from the second surface 30 of the outer sleeve 26, as shown in FIGS. 3 and 4. A plurality of external threads 90 are formed on the lower section 84. The threads 90 are configured for mating with internal threads of the mud motor 16 or another tool within the bottom hole assembly 14.

The stop element 86 has an upper and a lower base 92 and 94. The upper base 92 faces the second surface 30 of the outer sleeve 26, as shown in FIG. 3. An outer diameter of the stop element 86 is greater than that of the upper and lower sections 82 and 84. The outer diameter of the stop element 86 is the same or approximately the same as an outer diameter of the outer sleeve 26, as shown in FIG. 3.

Continuing with FIGS. 7-9, one or more laterally-extending inner ports 100 are formed in the upper section 82 of the lower body 60. The inner ports 100 join the longitudinal bore 56 to an exterior surface 102 of the lower body 60. The inner ports 100 are formed in the lower body 60 so that they are capable of aligning with the outer ports 46 formed in the outer sleeve 26 in a one-to-one relationship, as shown in FIGS. 3 and 4. The number of inner ports 100 formed in the lower body 60 corresponds with the number of outer ports 46 formed in the outer sleeve 26. Three inner ports 100 are shown in FIG. 9. In alternative embodiments, more than three or less than three inner ports may be formed in the lower body depending on the amount of outer ports formed in the outer sleeve.

With reference to FIGS. 5 and 9, a plurality of longitudinal grooves 104 are formed in the walls of the outer sleeve 26 surrounding the lower chamber 36. The grooves 104 are configured to receive a plurality of longitudinal lobes 106 formed on the exterior surface 102 of the upper section 82 of the lower body 60. Mating of the grooves 104 and lobes 106 allows the inner element 50 to move axially within the internal chamber 32, but prevents relative rotational movement between the outer sleeve 26 and the inner element 50. Preventing relative rotational movement of the outer sleeve 26 and the inner element 50 ensures that the ports 100 and 46 are aligned rotationally when also aligned longitudinally.

Continuing with FIGS. 3-6, a spring 108 is installed within the upper chamber 34 and is situated between the lower base 40 of the upper chamber 34 and the lower base 66 of the upper body 58. The spring 108 is disposed around the connector 62 of the inner element 50. Axial movement of the inner element 50 within the internal chamber 32 is limited by the stop element 86 and the spring 108.

The tool 24 is assembled by inserting the connector 62 into the internal chamber 32 through the second surface 30 of the outer sleeve 26. The first end 78 of the connector 62 is pushed through the passageway 38 until it is situated within the upper chamber 34, and the upper section 82 of the lower body 60 is situated within the lower chamber 36. The upper section 82 is installed within the lower chamber 36 such that its lobes 106 are disposed within the grooves 104.

Once the connector 62 is installed within the upper chamber 34, the spring 108 is then installed within the upper chamber 34 through the first surface 28 of the outer sleeve 26 and is disposed around the connector 62. The upper body 58 of the inner element 50 is installed within the upper chamber 34 through the first surface 28 and is attached to the connector 62.

In operation, pressurized fluid flowing through the drill string 20 enters the tool 24 through its first surface 28. The fluid flows into the upper chamber 34 from the first surface 28 and is funneled into the longitudinal bore 56. Once in the bore 56, the fluid is directed towards the inner ports 100 or continues downstream and exits the second surface 54 of the inner element 50, depending on the position of the inner element 50 within the outer sleeve 26. Pressurized fluid passing through the second surface 54 of the inner element 50 continues towards the mud motor 16.

Figure 10:
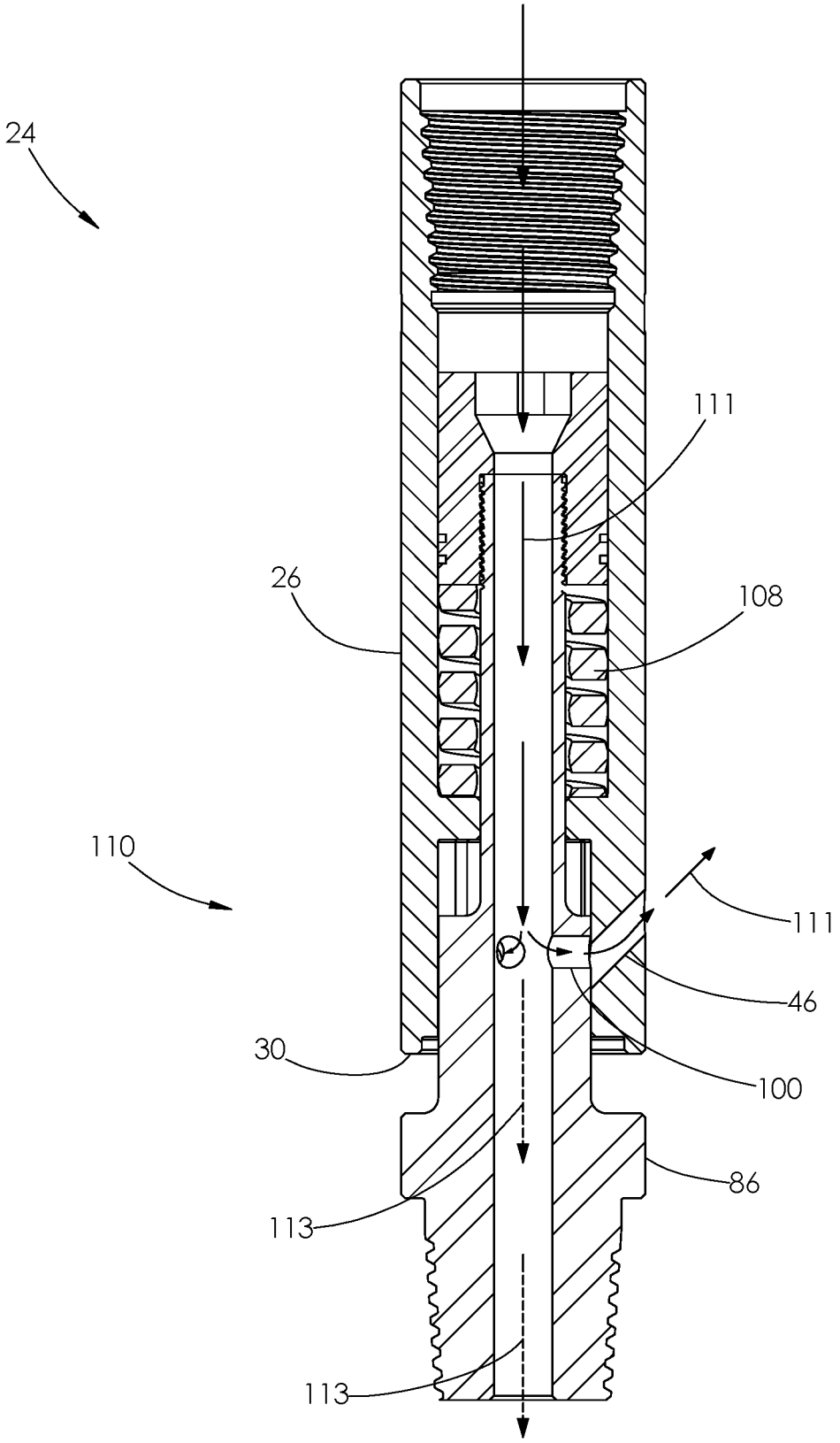
FIG. 10 is the cross-sectional view of the tool shown in FIG. 3.

The inner element 50 is movable between three different positions. With reference to FIG. 10, a first position 110 of the tool 24 is shown. When the tool 24 is in the first position 110, the spring 108 is relaxed. When the spring 108 is relaxed, the stop element 86 is spaced from the second surface 30 of the outer sleeve 26. Such spacing aligns the inner ports 100 with the outer ports 46. When the inner and outer ports 100 and 46 are aligned, pressurized fluid passes through the aligned ports 100 and 46 and into the environment surrounding the outer sleeve 26, as shown by the arrows 111. Thus, when the inner and outer ports 100 and 46 are aligned, pressurized fluid is diverted away from the mud motor 16 and milling tool 12. Some fluid may continue to pass through the second surface 54 of the inner element 50 and towards the mud motor 16, as shown by the arrows 113. However, such fluid has a decreased flow rate and pressure. As a result, such fluid is not sufficient enough to cause the mud motor 16 to rotate, thereby reducing wear on the mud motor 16 and the milling tool 12.

Figure 11:
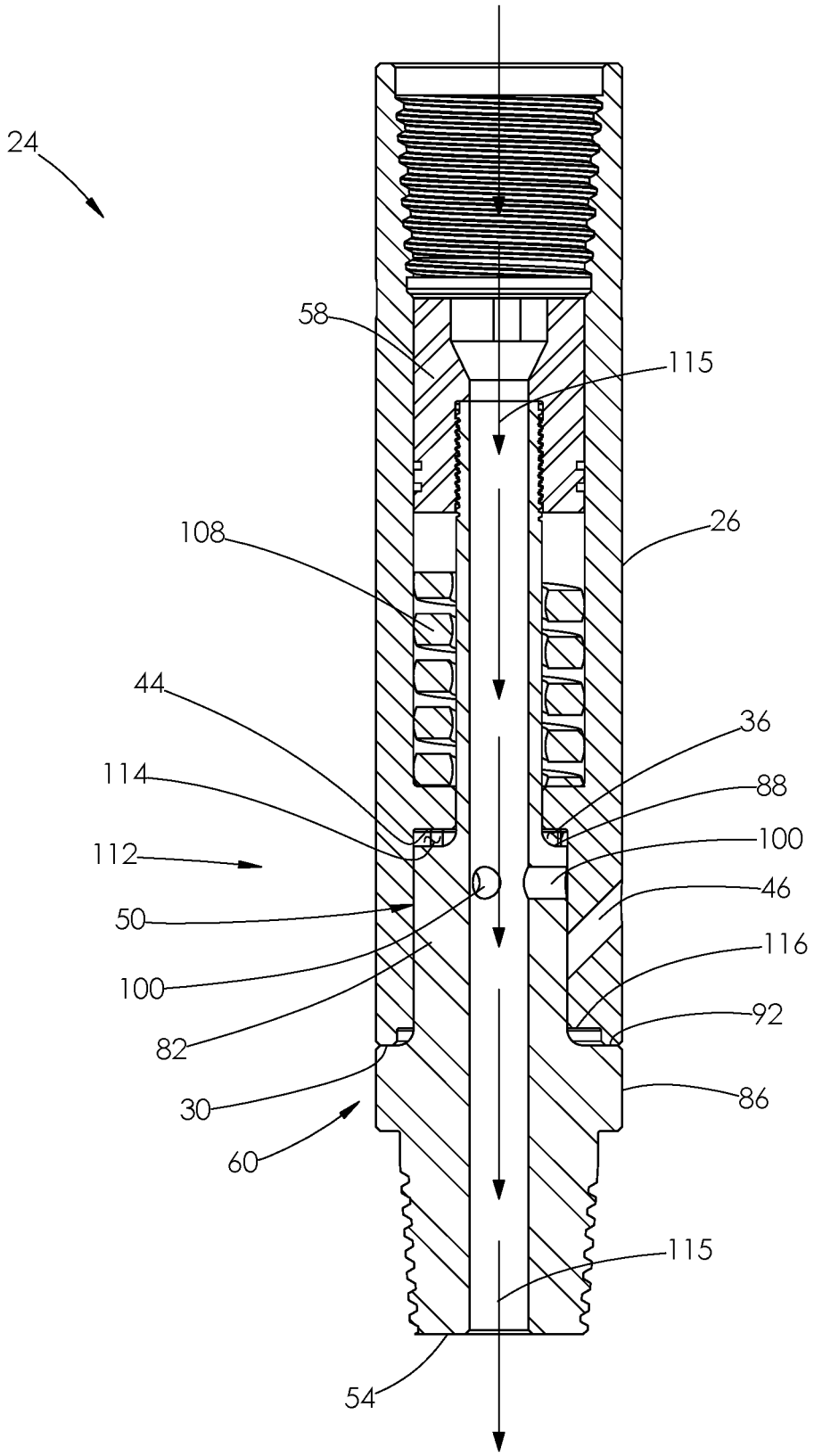
FIG. 11 is the cross-sectional view of the tool shown in FIG. 10, but the tool has been moved to the second position.
Figure 12:
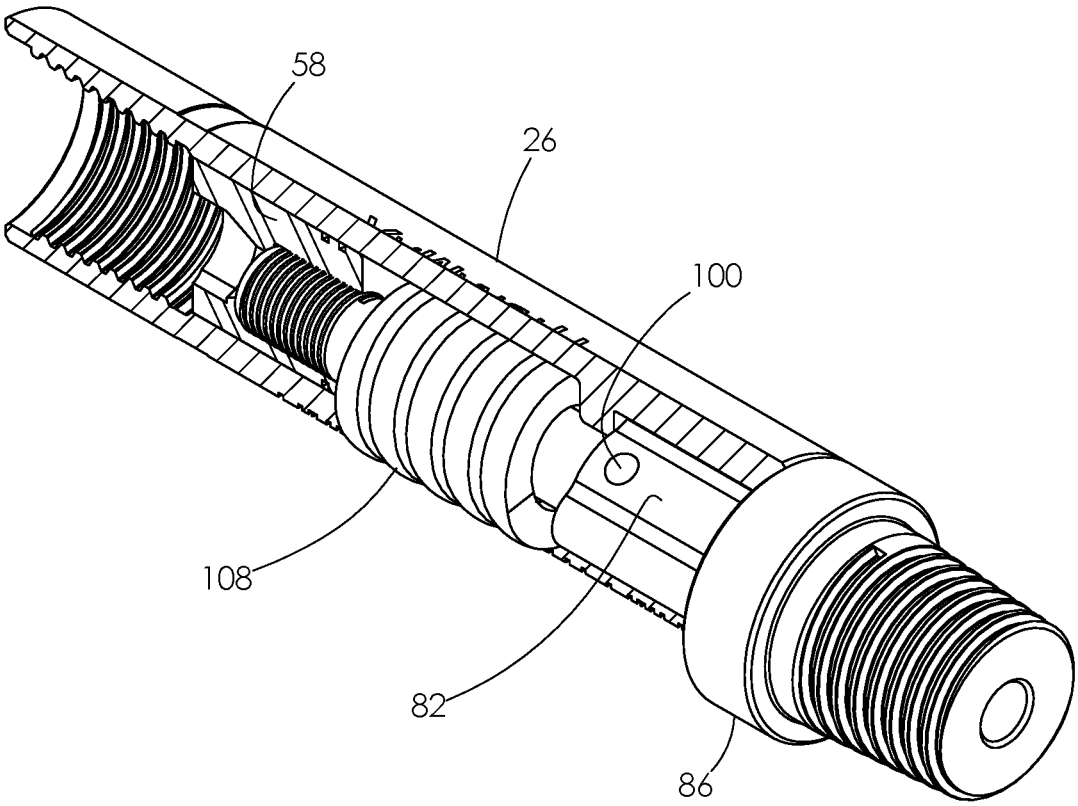
FIG. 12 is a perspective cutaway view of the tool shown in FIG. 11.

Turning to FIGS. 11 and 12, the tool 24 is shown in a second position 112. When the tool 24 is in the second position 112, the upper section 82 of the lower body 60 is moved upstream, causing the inner ports 100 to be positioned upstream of the outer ports 46. Upstream movement of the inner element 50 moves the upper body 58 away from the spring 108, allowing the spring 108 to remain relaxed. Further axial movement of the upper section 82 is prevented by engagement of the upper base 92 of stop element 86 with the second surface 30 of the outer sleeve 26.

Continuing with FIG. 11, when the stop element 86 is engaged with the outer sleeve 26, a gap 114 exists between the upper base 88 of the upper section 82 and the upper base 44 of the lower chamber 36. The gap 114 provides a space for excess fluid or debris to collect during operation without hindering the movement of the inner element 50. Likewise, a cutout 116 is formed in the second surface 30 of the outer sleeve 26. The cutout 116 provides space for excess fluid or debris to collect when the stop element 86 is engaged with the outer sleeve 26.

Continuing with FIGS. 11 and 12, when the inner and outer ports 100 and 46 are not aligned, pressurized fluid flowing through the bore 56 is blocked from exiting the inner ports 100. Instead, all of the pressurized fluid flows towards the second surface 54 of the inner element 50 and towards the mud motor 16, as shown by arrows 115 in FIG. 11.

Figure 13:
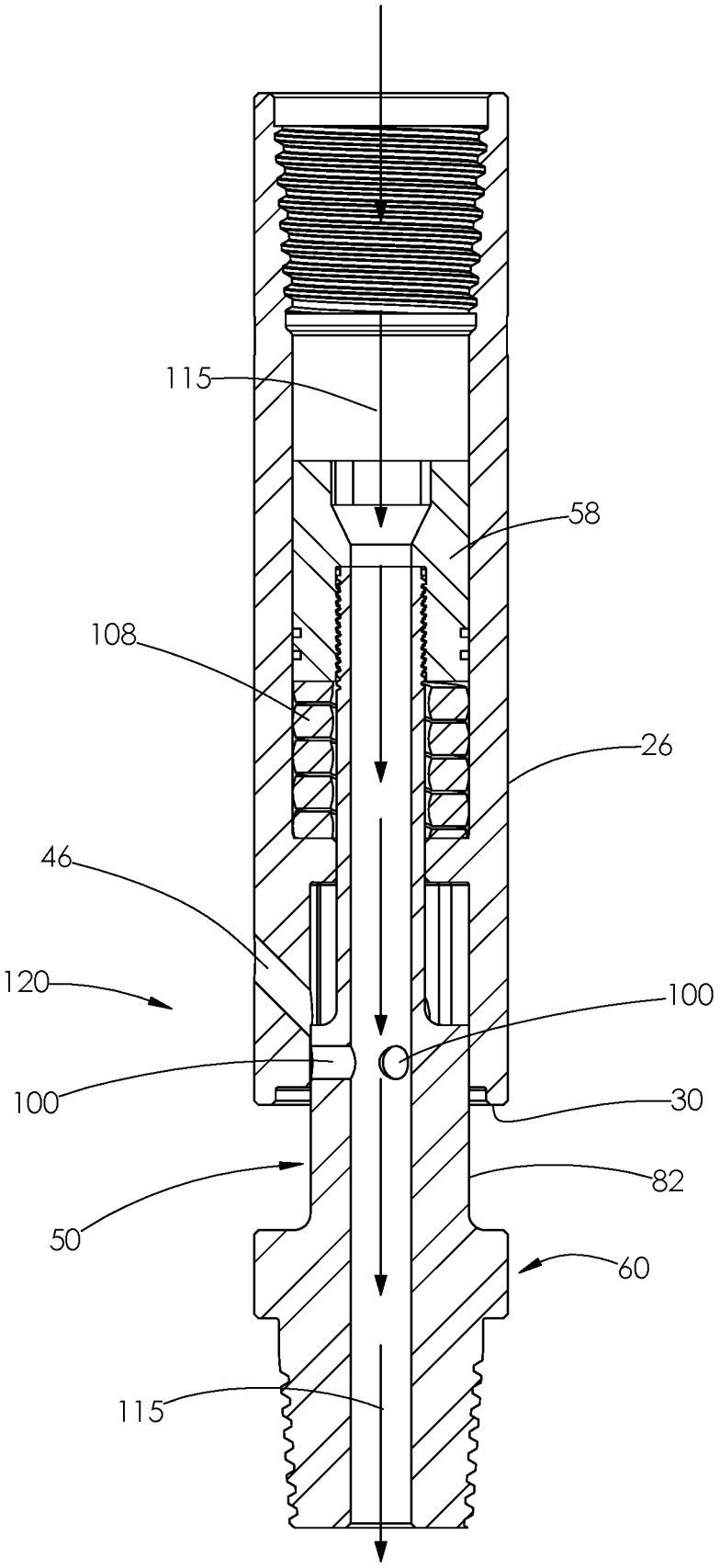
FIG. 13 is the cross-sectional view of the tool shown in FIGS. 10 and 11, but the tool has been moved to the third position.
Figure 14:
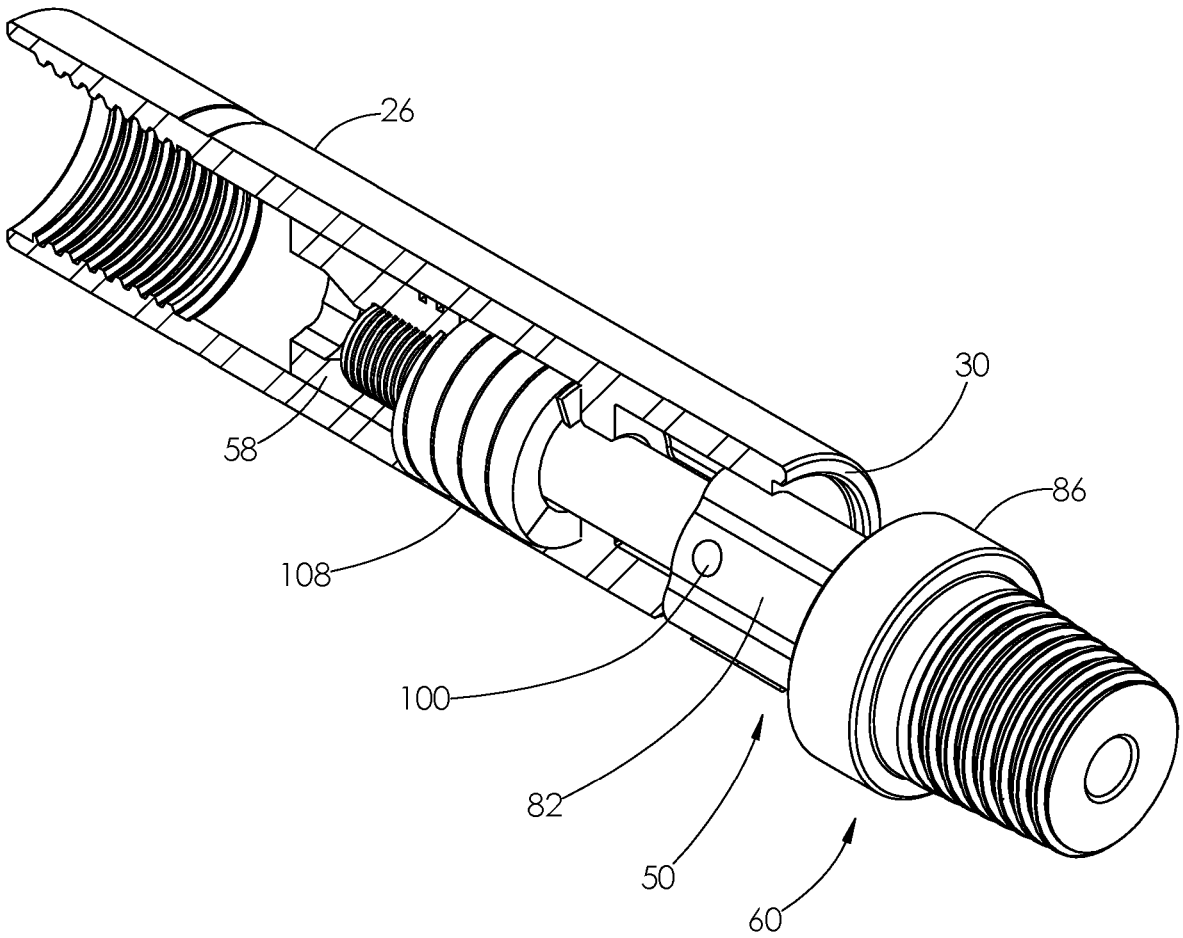
FIG. 14 is a perspective cutaway view of the tool shown in FIG. 13.

Turning to FIGS. 13 and 14, the tool 24 is shown in a third position 120. When the tool 24 is in the third position 120, the upper section 82 of the lower body 60 is moved downstream, causing the inner ports 100 to be positioned downstream of the outer ports 46. Downstream movement of the inner element 50 causes the upper body 58 to compress the spring 108. Further axial movement of the inner element 50 is prevented by the spring 108. The stop element 86 is spaced from the second surface 30 of the outer sleeve 26 when in the third position 120. The space between the stop element 86 and the outer sleeve 26 is greater when in the third position 120 than when in the first position 110.

Continuing with FIG. 13, as in the second position 112, when the inner and outer ports 100 and 46 are not aligned, pressurized fluid flowing through the bore 56 is blocked from exiting the inner ports 100. Instead, all of the pressurized fluid flows towards the second surface 54 of the inner element 50 and towards the mud motor 16, as shown by arrows 115.

In operation, as the bottom hole assembly 14 is lowered into the cased wellbore 18 by the drill string 20, the tool 24 is in the first position 110, diverting fluid away from the mud motor 16, as shown in FIG. 10. The first position 110 may be referred to as the "hanging flow" position. As the bottom hole assembly 14 is moved through the wellbore 18, the tool 24 will remain in the first position 110 until the milling tool 12 contacts or "bites" a hardened object, as shown for example by the hardened object 22 in FIG. 1.

Force may be applied to the inner element 50 of the tool 24, upon contact by the milling tool 12 with the hardened object 22. The force, if strong enough, will move the inner element 50 into the second position 112, causing all of the pressurized fluid to flow towards the mud motor 16 and milling tool 12, as shown in FIG. 11. The pressurized fluid powers the mud motor 16 and milling tool 12, allowing the milling tool 12 to grind up the hardened object 22. In some embodiments, at least 2,000 pounds of force must be applied to the inner element 50 to move the inner element 50 into the second position 112. The second position 112 may be referred to as the "closed thrusting" position.

After the milling tool 12 has finished milling the hardened object 22, force may no longer be applied to the inner element 50, allowing the inner element 50 to return to the first position 110, shown in FIG. 10. If the milling tool 12 encounters another hardened object within the cased wellbore 18, force may again be applied to the inner element 50 that is significant enough to move the inner element 50 into the second position 112, shown in FIG. 11. The tool 24 may repeatedly move between the first and second positions 110 and 112 as the bottom hole assembly 14 travels through the cased wellbore 18.

During operation, the milling tool 12 may become stuck on the hardened object 22 or other debris within the cased wellbore 18. One way to dislodge the milling tool 12 from the hardened object 22 is to pull on the drill string 20 from its upstream end at the ground surface 11, shown in FIG. 1. If the drill string 20 is pulled upstream, a pulling force is applied to the tool's outer sleeve 26. As a pulling force is applied to the outer sleeve 26, an opposed pulling force may be applied to the inner element 50 because the inner element is attached to the stuck milling tool 12. The opposing forces cause the inner element 50 to move axially downstream. Such movement causes the upper body 58 to compress the spring 108 and moves the inner element 50 into the third position 120, shown in FIG. 13. Such position may be referred to as the "max pull" position.

During operation, the tool 24 may repeatedly move between the first position 110, the second position 112, and the third position 120, depending on the forces being applied to the tool 24. An operator may vary the amount of fluid diverted from the mud motor 16 when the tool 24 is in the first position 110 by plugging one or more of the inner ports 100. The inner ports 100 may be plugged using one or more plugs 122, as shown for example in FIGS. 5, 6, and 9.

Continuing with FIG. 9, a plurality of internal threads (not shown) may be formed in the walls of the lower body 60 surrounding the inner ports 100. The threads may mate with external threads (not shown) formed on each of the plugs 122 so as to secure the plug 122 to a corresponding port 100. In alternative embodiments, a plug may be press-fit into a corresponding port. A polygonal recess 128 may be formed in an outer surface of each plug 122 for mating with a tool used to install and remove a plug 122 from one of the inner ports 100. The more inner ports 100 plugged, the more fluid that will flow towards the mud motor 16 when the tool 24 is in the first position 110.

Figure 15:
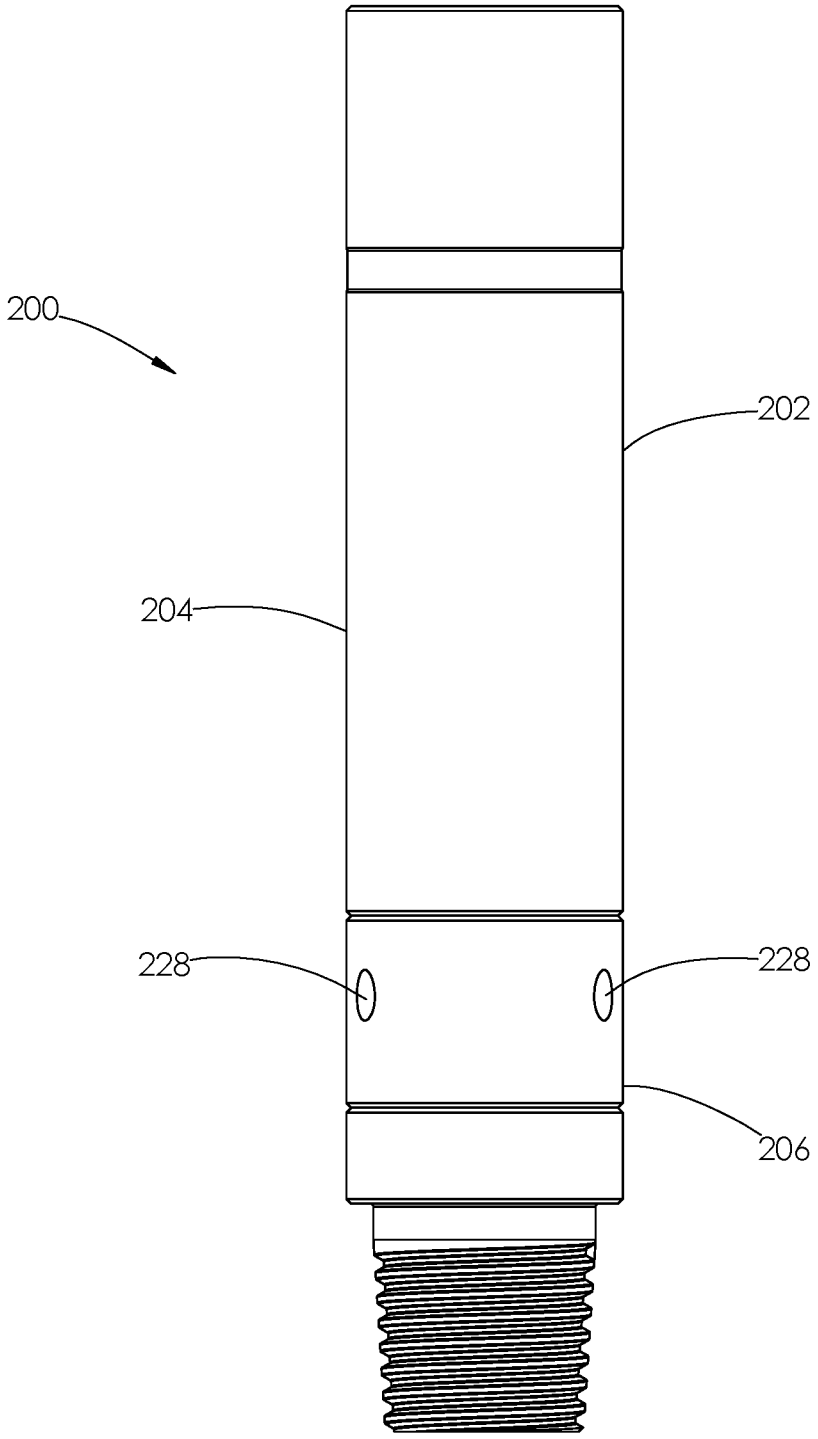
FIG. 15 is a side elevational view of another embodiment of a variable flow diverter tool.
Figure 16:
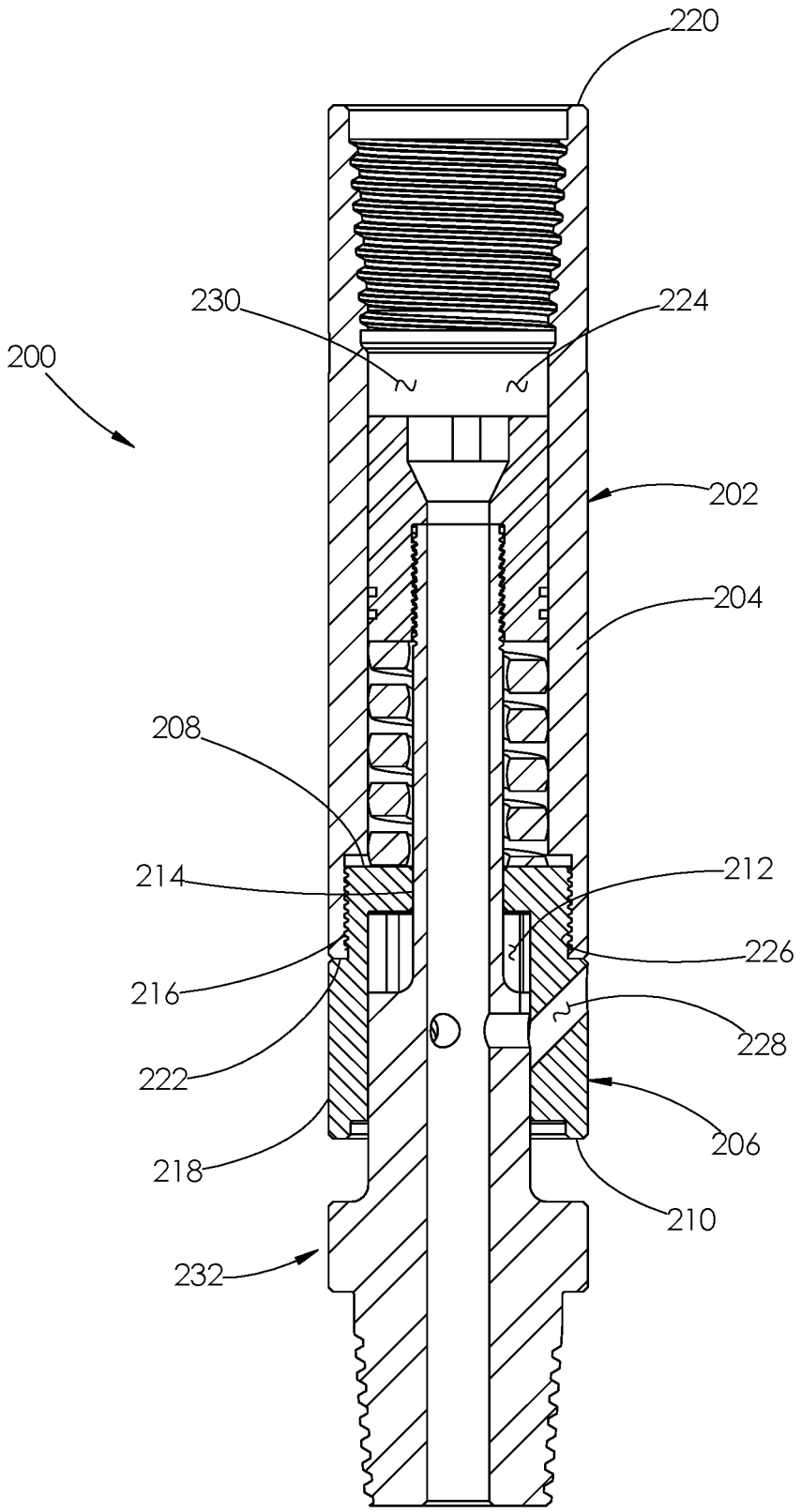
FIG. 16 is a side elevational cutaway view of the tool shown in FIG. 15.

With reference to FIGS. 15 and 16, an alternative embodiment of variable flow diverter tool 200 is shown. The tool 200 is identical to the tool 24 with the exception of its outer sleeve 202. The outer sleeve 26 shown in FIGS. 3-6 is of one-piece construction. In contrast, the outer sleeve 202 shown in FIGS. 15 and 16 is of two-piece construction. The outer sleeve 202 comprises an upper sleeve 204 joined to a collar 206.

The collar 206 has an upper base 208 joined to a lower base 210 by a lower chamber 212 and a constricted passageway 214. A plurality of external threads 216 are formed in the outer surface of the collar 206 surrounding the passageway 214. One or more laterally-extending outer ports 228 are formed in the collar 206, as shown in FIG. 15. The outer ports 228 interconnect the lower chamber 212 and an exterior surface 218 of the collar 206.

The upper sleeve 204 comprises a first surface 220 joined to a second surface 222 by an internal chamber 224. A plurality of internal threads 226 are formed in the interior walls of the upper sleeve 204 adjacent its second surface 222. The internal threads 226 are configured for mating with the external threads 216 on the collar 206. When the collar 206 is installed within the upper sleeve 204, an upper chamber 230 is formed within the upper sleeve 204 between its first surface 220 and the upper base 208 of the collar 206. The combined upper sleeve 204 and collar 206 function in the same manner as the outer sleeve 26.

The tool 200 further comprises an inner element 232. The inner element 232 is identical to the inner element 50, shown in FIGS. 3-6. During operation, the tool 200 functions in the same manner as the tool 24.

The tool 24 is described herein as having the inner element 50 attached to the mud motor 16, or other tool positioned between the tool 24 and the mud motor 16. Thus, the tool 24 is incorporated into the bottom hole assembly 14 such that the tool 24 is positioned "pin down". In alternative embodiments, the outer sleeve 26 may be attached to the mud motor 16, or other tool positioned between the tool 24 and the mud motor 16. Thus, the tool 24 may be incorporated into the bottom hole assembly 14 such that the tool 24 is positioned upstream or "pin up". In such case, the tool 24 functions in the same manner described herein, but the inner element 50 will move downstream when moving to the second position 112, and upstream when moving the third position 120. Likewise, the tool 200 may be positioned "pin up" or "pin down" within the bottom hole assembly 14.

Changes may be made in the construction, operation and arrangement of the various parts, elements, steps and procedures described herein without departing from the spirit and scope of the invention as described in the following claims. Unless otherwise stated herein, any of the various parts, elements, steps and procedures that have been described should be regarded as optional, rather than as essential.

The invention claimed is:

1. A downhole tool, comprising:

an elongate outer sleeve, comprising:

an upper internal chamber having a base;

a lower internal chamber longitudinally spaced from the upper internal chamber and having one or more outer ports interconnecting the lower chamber with an exterior surface of the outer sleeve; and a constricted passageway joining the upper and lower internal chambers;

an elongate inner element having opposed ends and a longitudinal bore extending therethrough, and comprising:

an enlarged upper body formed at one of the ends, the upper body having a base and being situated within the upper chamber;

an enlarged lower body formed at the opposite end, in which a portion of the lower body is situated within the lower chamber and has one or more laterally-extending inner ports that join the bore to an exterior surface of the lower body; and a constricted connector that rigidly joins the upper and lower bodies and extends within the passageway; and a spring installed within the upper chamber and situated between the base of the upper body and the base of the upper chamber;

in which at least one outer port aligns with a corresponding one of the inner ports when the spring is relaxed; and in which the lower chamber is sized such that the corresponding one of the inner ports may be positioned on either longitudinal side of the associated outer port, in a non-aligning relationship thereto.

2. The downhole tool of claim 1, in which the lower body and the lower chamber are constrained against relative rotation.

3. The downhole tool of claim 1, in which the outer sleeve is of multi-piece construction.

4. The downhole tool of claim 1, in which the inner element is of multi-piece construction.

5. The downhole tool of claim 1, in which the inner element is configured to move relative to the outer sleeve such that the inner element is movable between:

a first position, in which the inner ports are at least partially aligned with the outer ports;

a second position, in which the inner ports are positioned upstream from the outer ports; and a third position, in which the inner ports are positioned downstream from the outer ports.

6. A system, comprising:

a cased wellbore;

an elongate drill string installed within the wellbore; and the downhole tool of claim 1 installed within the wellbore and incorporated into the drill string.

7. A downhole tool, comprising:

an elongate outer sleeve having opposed first and second surfaces interconnected by an internal chamber, and having one or more outer ports interconnecting the internal chamber with an exterior surface of the outer sleeve;

an elongate inner element, in which a portion of the inner element is installed within the internal chamber, the inner element having opposed ends and a longitudinal bore extending therethrough, and comprising:

an enlarged upper body formed at one of the ends, the upper body situated within the internal chamber;

an enlarged lower body formed at the opposite end, the lower body having one or more laterally-extending inner ports formed therein and extending therethrough, and comprising a stop element positioned outside of the internal chamber; and a constricted connector that rigidly joins the upper and lower bodies;

in which the inner element is configured to move relative to the outer sleeve such that the inner element is movable between:

a first position, in which at least one of the inner ports is at least partially aligned with a corresponding one of the outer ports;

a second position, in which at least one of the inner ports is not aligned with a corresponding one of the outer ports and the stop element is engaging the second surface of the outer sleeve; and a third position, in which at least one of the inner ports is not aligned with a corresponding one of the outer ports and the stop element is spaced from the second surface of the outer sleeve.

8. The downhole tool of claim 7, in which the outer sleeve is of multi-piece construction.

9. The downhole tool of claim 7, in which the internal chamber of the outer sleeve comprises:

an upper internal chamber having a base;

a lower internal chamber longitudinally spaced from the upper internal chamber and having the one or more outer ports; and a constricted passageway joining the upper and lower internal chambers.

10. The downhole tool of claim 7, further comprising a spring disposed within the internal chamber and positioned between the upper body and the lower body of the inner element.

11. The downhole tool of claim 7, in which the outer sleeve and the inner element are constrained against relative rotation.

12. A system, comprising:

a cased wellbore;

an elongate drill string installed within the wellbore; and the downhole tool of claim 7 installed within the wellbore and incorporated into a bottom hole assembly attached to the drill string.

13. The system of claim 12, further comprising:

a hardened object disposed within the cased wellbore;

a milling tool incorporated into the bottom hole assembly;

in which the milling tool engages the hardened object and the downhole tool is in the second position.

14. A method, comprising:

incorporating the downhole tool of claim 7 into a bottom hole assembly attached to a drill string;

lowering the bottom hole assembly into a cased wellbore while the downhole tool is in the first position.

15. The method of claim 14, further comprising:

pulling on an upstream end of the drill string and thereby moving the downhole tool into the third position.

16. A system comprising:

the downhole tool of claim 7; and a flow of pressurized fluid within the inner element.

17. The system of claim 16, in which the downhole tool is in the first position and the flow of pressurized fluid passes through the inner and outer ports.

18. The system of claim 16, in which the downhole tool is in the second position and the flow of pressurized fluid does not pass through the inner and outer ports.

19. The system of claim 16, in which the downhole tool is in the third position and the flow of pressurized fluid does not pass through the inner and outer ports.

20. A downhole tool, comprising:

an elongate outer sleeve, comprising:

an upper internal chamber having a base;

a lower internal chamber longitudinally spaced from the upper internal chamber and having one or more outer ports interconnecting the lower chamber with an exterior surface of the outer sleeve; and a constricted passageway joining the upper and lower internal chambers;

an elongate inner element having opposed ends and a longitudinal bore extending therethrough, and comprising:

an enlarged upper body formed at one of the ends, the upper body having a base and being situated within the upper chamber;

an enlarged lower body formed at the opposite end, in which a portion of the lower body is situated within the lower chamber and has one or more laterally-extending inner ports that join the bore to an exterior surface of the lower body; and a constricted connector that rigidly joins the upper and lower bodies and extends within the passageway; and a spring installed within the upper chamber and situated between the base of the upper body and the base of the upper chamber;

in which at least one outer port aligns with a corresponding one of the inner ports when the spring is relaxed; and in which the inner element is configured to move relative to the outer sleeve such that the inner element is movable between:

a first position, in which the inner ports are at least partially aligned with the outer ports;

a second position, in which the inner ports are positioned upstream from the outer ports; and a third position, in which the inner ports are positioned downstream from the outer ports.

* * * * *